US006109950A

United States Patent [19]

Trammel

[11] Patent Number: 6,109,950

[45] Date of Patent: Aug. 29, 2000

[54] IDC CONNECTOR HAVING A TERMINATOR

[75] Inventor: John D. Trammel, Winston Salem, N.C.

[73] Assignee: Hon Hai Precision Ind. Co., Ltd., Taipei Hsien, Taiwan

[21] Appl. No.: 09/351,993

[22] Filed: Jul. 12, 1999

[51] Int. Cl.[7] ..... H01R 4/24

[52] U.S. Cl. ..... 439/404; 439/76.1; 439/499

[58] Field of Search ..... 439/404, 405, 439/76.1, 492, 499, 498

[56] References Cited

U.S. PATENT DOCUMENTS

| | | | |
|---|---|---|---|
| 4,932,873 | 6/1990 | La Shier | 439/404 |
| 5,108,294 | 4/1992 | Marsh et al. | 439/76.1 |
| 5,472,348 | 12/1995 | Daly et al. | 439/76.1 |
| 5,636,998 | 6/1997 | Daly et al. | 439/76.1 |
| 5,752,840 | 5/1998 | Wu et al. | 439/76.1 |
| 5,820,403 | 10/1998 | Cheng et al. | 439/405 |

*Primary Examiner*—Gary F. Paumen
*Attorney, Agent, or Firm*—Wei Te Chung

[57] ABSTRACT

An IDC connector having a terminator thereon comprises a dielectric housing having an array of terminals assembled within the housing. Each terminal includes an insulation displacement section extending beyond a mating face of the housing. A cover is assembled to the mating face for terminating a flat flexible cable to the insulation displacement sections. A terminator is electrically connected to a free end of the flat flexible cable. The terminator is assembled to the cover. A cap enclosing the terminator therein is assembled to the housing.

12 Claims, 3 Drawing Sheets

IDC CONNECTOR HAVING A TERMINATOR

FIELD OF THE INVENTION

The present invention relates to an IDC connector, and more particularly to an IDC connector having a terminator thereon.

DESCRIPTION OF PRIOR ART

SCSI3 LVD cable assembly is built using 68 pin IDC plug connector with a terminator on a free end of the cable. The terminator is a separate assembly from the last connector on the SCSI bus and requires 68 pin IDC through hole connector on a circuit board and a cover enclosing the IDC connector. In addition, the terminator is beyond the last IDC connector about 76 mm. This is disadvantageous not only will it increase clutter inside the computer equipment, but also will it increase the length/cost of the cable assembly.

SUMMARY OF THE INVENTION

An objective of this invention is to provide an IDC connector having a terminator securely assembled thereto thereby reducing clutter in the computer housing and cost of the connector assembly.

In order to achieve the object set forth, an IDC connector having a terminator thereon comprises a dielectric housing having an array of terminals assembled within the housing. Each terminal includes an insulation displacement section extending beyond a mating face of the housing. A cover is assembled to the mating face for terminating a flat flexible cable to the insulation displacement sections. A terminator is electrically connected to a free end of the flat flexible cable. The terminator is assembled to the cover.

According to an aspect of the present invention, a cap enclosing the terminator therein is assembled to the housing thereby providing a neat appearance.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
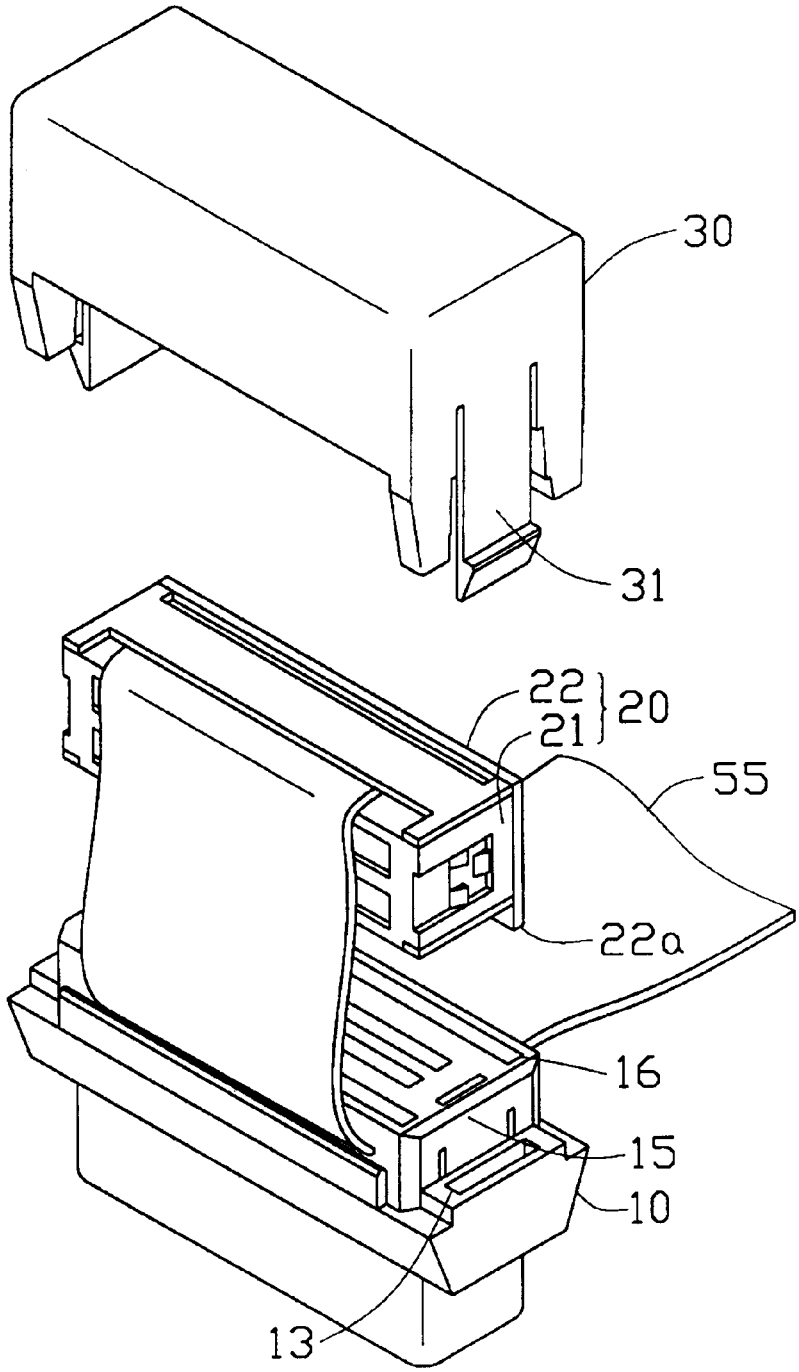
FIG. 1 is an exploded view of an IDC connector in accordance with the present invention.
Figure 2:
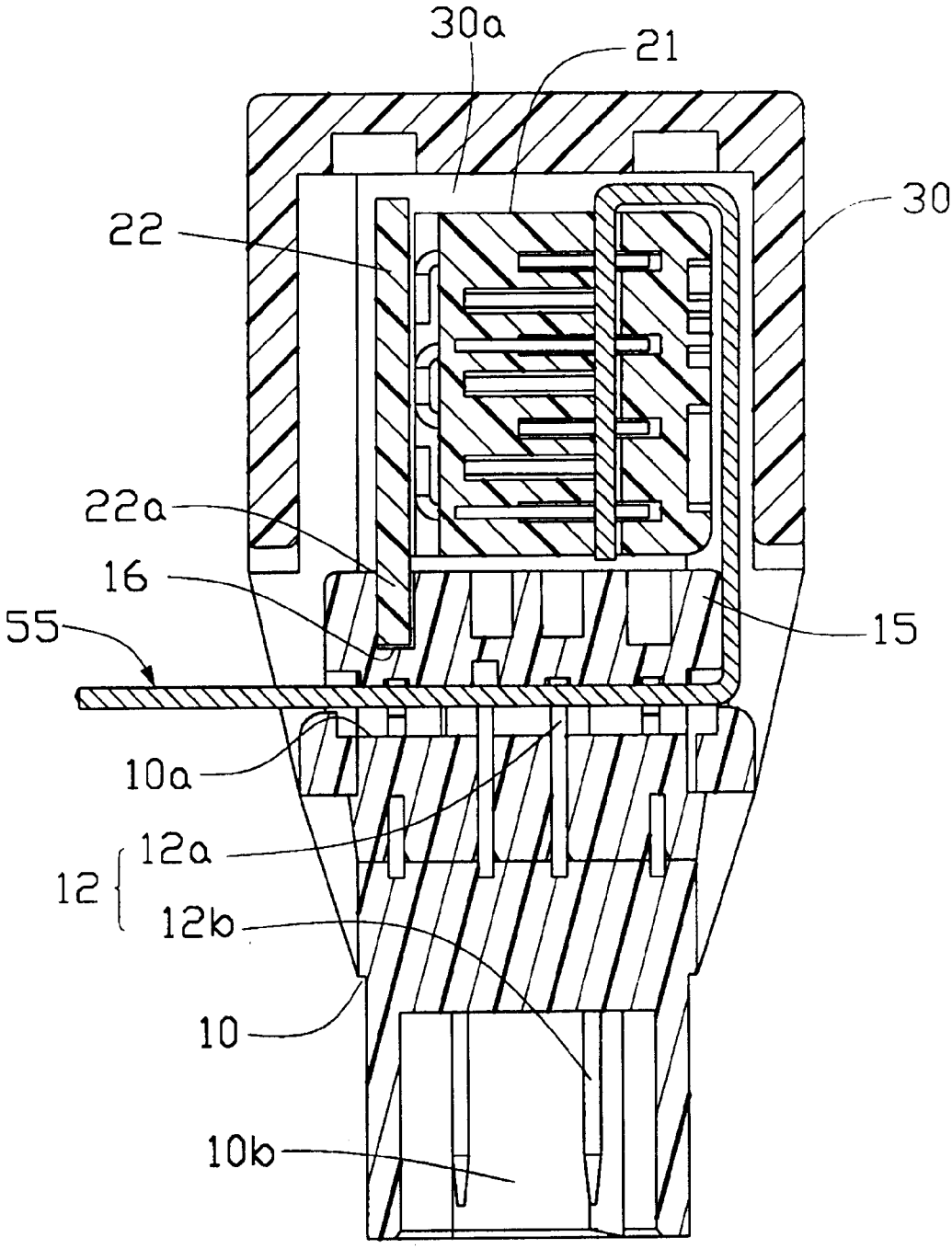
FIG. 2 is an assembled cross sectional view of the IDC connector of FIG. 1.
Figure 3:
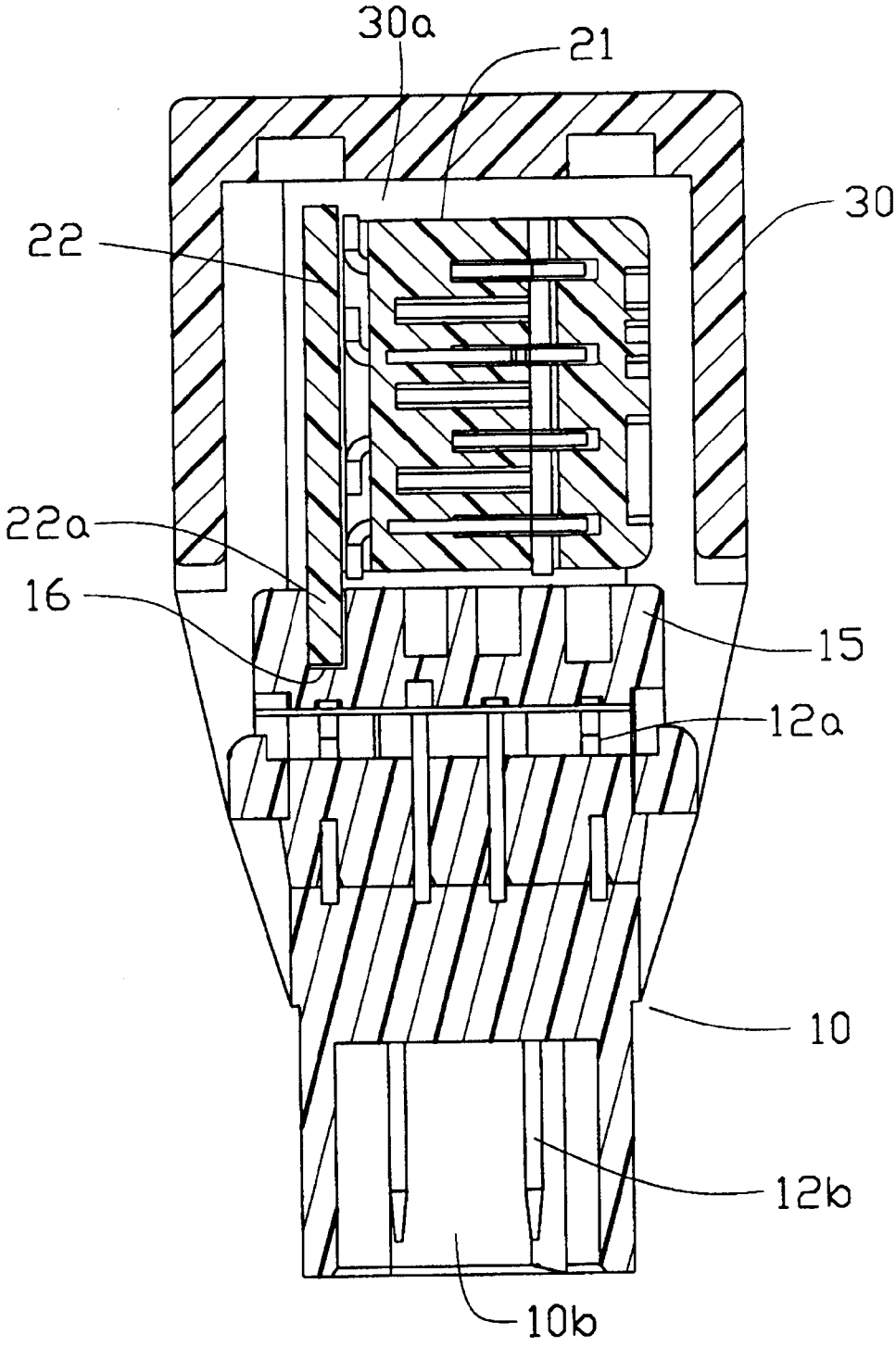
FIG. 3 is similar to FIG. 2 expect a flat flexible cable is removed for simplicity.

Referring to FIGS. 1 and 2, an IDC connector 1 in accordance with the present invention comprises a dielectric housing 10 having terminating face 10*a* and a receiving cavity 10*b* and an array of passageways (not labeled) in the housing 10. An array of terminals 12 is assembled within the array of passageways. Each terminal 12 includes a base portion (not shown) fixedly assembled in the passageways of the housing 10, an insulation displacement section 12*a* extending beyond the mating face 10*a*, and a connecting portion 12*b* extends into the cavity 10*b*. The housing 10 further defines a pair of retaining channels 13 on opposite ends thereof.

A terminating cover 15 is assembled to the mating face 10*a* of the housing 10 for terminating a flat flexible cable 55 to the insulation displacement sections 12*a* of the terminal 12. The terminating cover 15 forms a pair of latches on opposite ends thereof for engagement to the dielectric housing 10. Since this is known to the skill in the art and no further description is given. Four elongate slots 16 are defined on a top face of the terminating cover 15.

A terminator 20 is electrically terminated to a free end of the flat flexible cable 55. The terminator 20 includes an IDC connector 21 with a plurality of contacts 23 thereof wherein the insulation displacement sections 23*a* of the contacts 23 pierce into the end of the cable 55 and the connecting portions 23*b* thereof are soldered to a printed circuit board 22. The printed circuit board 22 has a portion 22*a* extending beyond the IDC connector 21. The extended portion 22*a* can be fixedly and securely received in the elongate slot 16 of the terminating cover 15. By this arrangement, not only will the terminator 20 be fixedly attached to the terminating cover 15 of the IDC connector 1, but also will reduce the length of the cable 55 extending beyond the IDC connector 1. Accordingly, the clutter within the computer equipment is advantageously eliminated. In addition, the shorter the length, the lower the cost.

A cap 30 is assembled to the housing 10 and which defines a space 30*a* therein to enclose the terminator 20 and the flat flexible cable 55 therein. The cap 30 includes a pair of latches 31 extending from opposite ends thereof. When the cap 30 is assembled to the housing 10, the latches 31 extend into the retaining channel 13 of the housing 10 and engage to a lower edge (not labeled) of the channel 13 while the terminator 20 and the flat flexible cable 55 are also enclosed by the cap 30.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An IDC connector having a terminator thereon, comprising:

a dielectric housing having mating and connecting faces and an array of passageways defined therebetween;

an array of terminals assembled within said array of passageways, each terminal including an insulation displacement section extending beyond said mating face and a connecting portion received within said passageway;

a cover assembled to said mating face of said housing for terminating a flat flexible cable to said insulation displacement sections, said cover forming a pair of latches on opposite ends thereof for engagement to said dielectric housing;

a terminator electrically connected to a free end of said flat flexible cable; and interconnecting means between said cover and said terminator for attaching said terminator to said cover;

wherein said interconnecting means includes a printed circuit board of said terminator and a retaining slot defined in a top surface of said cover which receives the circuit board therein.

2. The IDC connector as recited in claim 1, further comprising a cap assembled to said housing for enclosing said terminator therein.

3. The IDC connector as recited in claim 2, wherein said cap includes a pair of latches extending from opposite ends.

4. the IDC connector as recited in claim 3, wherein said housing includes a pair of retaining channels corresponding to said latches of said cap.

5. An IDC connector having a terminator thereon, comprising:

a dielectric housing having mating and connecting faces and an array of passageways defined therebetween;

an array of terminals assembled within said array of passageways, each terminal including an insulation displacement section extending beyond said mating face and a connecting portion received within said passageway;

a cover assembled to said mating face of said housing for terminating a flat flexible cable to said insulation displacement sections, said cover forming a pair of latches on opposite ends thereof for engagement to said dielectric housing;

a terminator electrically connected to a free end of said flat flexible cable;

a cap assembled for enclosing said terminator therein;

interconnecting means between said cover and said terminator for attaching said terminator to said cover; and interengaging means between said cap and said housing for attaching said cap to said housing;

wherein said interconnecting means includes a printed circuit board of said terminator and a retaining slot defined in a top surface of said cover which receives the circuit board therein.

6. A cable connector assembly comprising:

a flat cable;

an IDC connector positioned around one end of the cable and including a dielectric housing defining a mating face coupled to said cable and an opposite connecting face adapted to mate with a complementary connector;

a plurality of terminals positioned in the housing, each of said terminals including an insulation displacement section extending beyond the mating face and a connecting portion extending toward the connecting face;

a cover assembled to the mating face of the housing and terminating said cable to the insulation displacement sections by securely sandwiching said cable between the cover and the mating face; and a terminator assembled to the connector and terminating said end of the cable;

wherein said terminator includes another IDC connector with a plurality of contacts, and each of said contacts defines an insulation displacement section piercing into the end of the cable and a connecting portion electrically connected to a printed circuit board of the terminator.

7. The cable connector assembly as recited in claim 6, wherein said terminator includes another IDC connector with a plurality of contacts, and each of said contacts defines an insulation displacement section piercing into the end of the cable and a connecting portion electrically connected to a printed circuit board of the terminator.

8. The cable connector assembly as recited in claim 7, wherein said terminator is positioned atop the connector.

9. The cable connector assembly as recited in claim 7, wherein a cap encloses the terminator and the associated cable.

10. An IDC connector assembly for use with one end of a flat cable, comprising:

a dielectric housing defining a mating face adapted to couple to said cable and an opposite connecting face adapted to mate with a complementary connector;

a plurality of terminals positioned in the housing, each of said terminals including an insulation displacement section extending beyond the mating face and a connecting portion extending toward the connecting face;

a cover assembled to the mating face of the housing and adapted to cooperate with the mating face to sandwich the cable therebetween for terminating said cable to the insulation displacement sections;

a terminator assembled to the connector and including a plurality of contacts thereof; and for terminating said end of the cable; and interconnecting means between said cover and said terminator for attaching said terminator to said cover;

wherein said interconnecting means includes a printed circuit board of said terminator and a retaining slot defined in a top surface of said cover which receives the circuit board therein.

11. The connector assembly as recited in claim 10, wherein said terminator is positioned atop the connector.

12. The connector assembly as recited in claim 10, wherein a cap is attached to the connector and encloses the terminator and the associated cable therein.

* * * * *